US007022925B2

(12) United States Patent
Reed et al.

(10) Patent No.: US 7,022,925 B2
(45) Date of Patent: Apr. 4, 2006

(54) ACOUSTIC PULSE TRANSFER SYSTEM FOR EVENT COUNTING

(75) Inventors: John W. Reed, Baltimore, MD (US); Roy Colquitt, Columbia, MD (US)

(73) Assignee: Progressive Engineering Technologies Corp., Columbia, MD (US)

( * ) Notice: Subject to any disclaimer, the term of this patent is extended or adjusted under 35 U.S.C. 154(b) by 224 days.

(21) Appl. No.: 10/270,389

(22) Filed: Oct. 15, 2002

(65) Prior Publication Data

US 2003/0085817 A1 May 8, 2003

Related U.S. Application Data

(60) Provisional application No. 60/329,734, filed on Oct. 18, 2001.

(51) Int. Cl.
*H01H 3/14* (2006.01)

(52) U.S. Cl. ..... 200/86 A; 200/61.22; 340/933; 340/940

(58) Field of Classification Search ..... 200/86 A, 200/86 R, 61.22, 85 R; 340/933, 939, 940–943
See application file for complete search history.

(56) References Cited

U.S. PATENT DOCUMENTS 3,949,355 A * 4/1976 Newmeyer ..... 340/940
4,365,124 A * 12/1982 Robinson ..... 200/81.5
4,908,483 A * 3/1990 Miller ..... 200/61.43
5,450,077 A * 9/1995 Tyburski ..... 340/933
5,463,385 A * 10/1995 Tyburski ..... 340/933
5,661,474 A * 8/1997 Douglas ..... 340/940
6,417,785 B1 * 7/2002 Tyburski ..... 340/941

* cited by examiner

*Primary Examiner*—Kyung Lee
(74) *Attorney, Agent, or Firm*—Foley & Lardner LLP

(57) ABSTRACT

An acoustic pulse transfer device according to the invention has one or more carrier segments that can be connected together to transport acoustic pulses through them. Acoustic pulses generated by events in a first segment are transported through a second segment, which may or may not have its own acoustic pulse generator generating acoustic pulses in response to different events. Acoustic pulses generated in the first and second segments are then independently transported through a third segment. Any number of such segments can be connected together. Typically, acoustic pulses are generated by compressing a pneumatic tube in a carrier segment. The pneumatic tube is connected to a substantially non-compressible acoustic pulse carrier tube connected to the segment's pneumatic tube through a trough in a wall separating the pneumatic tube from the acoustic pulse carrier tube. Multiple carrier segments can be linked together so that a acoustic pulse generated in a distant carrier segment can be transported through one or more segments toward a device actuated by the acoustic pulse such as a counter. The invention is particularly useful in traffic counting applications.

7 Claims, 6 Drawing Sheets

ACOUSTIC PULSE TRANSFER SYSTEM FOR EVENT COUNTING

FIELD OF THE INVENTION

The invention relates to acoustic pulse activated systems and finds particular use in event counting systems, such as traffic counters. In particular, the invention relates to a method and apparatus for transferring an acoustic pulse.

RELATED ART

Systems exist which record events by counting pneumatic pulses. Vehicular traffic counters, which produce pulses when a vehicle crosses over a pneumatic tube, are one example of such systems. FIG. 1 illustrates one such conventional vehicular traffic counting system. FIG. 1 shows a system configured to count two lanes of traffic using four pneumatic tubes connected to a conventional acoustic pulse counter, used in traffic counting applications. In FIG. 1, a vehicle travelling in Lane 1 crosses and compresses pneumatic tubes 101, 102, 103 and 104, thereby creating four acoustic pulses. A vehicle travelling in lane 2 crosses only pneumatic tubes 102 and 104, creating only two acoustic pulses. Based on the timing of the acoustic pulses it receives, counter 105 determines whether the vehicle has passed in lane one or lane two and increments the count appropriately. One difficulty with such systems is that they require a large number of pneumatic tubes, which must be individually connected to the counter. The large number of tubes and their individual connections requires long set-up times. Such systems are also susceptible to reliability problems resulting from the number of vulnerable connections. In addition, the pneumatic tubes themselves are subject to damage from the constant stress induced by vehicular traffic.

SUMMARY AND OBJECTS OF THE INVENTION

In view of the limitations of conventional systems, it is an object of the invention to provide an acoustic pulse counter system that is simpler and easier to use than conventional systems.

A system according to the invention employs a protected acoustic tube that can be connected to a pneumatic tube to allow transfer of an acoustic pulse. According to the invention, one or more acoustic tubes are inserted into a protective carrier. The protective carrier also contains a pneumatic tube that can be connected to any one of the acoustic tubes to count the desired acoustic pulses. The protective carrier can be configured in carrier segments which can be used alone or can be connected together to count events occurring in more than one channel. One example application is the use of several segments to count individual lanes of vehicular traffic.

A system according to the invention is easier to set up and more reliable than conventional systems. According to the invention, a carrier segment has a base member with one or more acoustic pulse carrier tubes therein. The acoustic pulse carrier tubes are formed of a substantially non-compressible material, such as metal or hard plastic, to allow free transmission of acoustic pulses without undesired noise pulses. A carrier segment may also have an acoustic pulse generator, such as a compressible pneumatic tube. The acoustic pulse generator, such as the pneumatic tube, is connected to one or more selected acoustic pulse carrier tubes which transmits the generated acoustic pulse to the end of the carrier segment for connection to a counting device directly or through other carrier segments. Such other carrier segments may serve solely as a conduit or may also have the ability to generate other acoustic pulses to be carried through other acoustic pulse carrier tubes therein to form a multi-channel counting device. The carrier segments may be configured to contain as many acoustic pulse generators, such as compressible pneumatic tubes, and acoustic pulse carrier tubes as desired. The carrier segments can be assembled at a factory or can be assembled on site by inserting the desired acoustic pulse carrier tubes and pneumatic tubes. Since on site customization is possible, a system according to the invention is particularly suited to being supplied in kit form. Moreover, carrier segments according to the invention may be used alone or in combination with conventional pneumatic counting tubes and can be used with conventional acoustic pulse counting devices.

BRIEF DESCRIPTION OF THE DRAWINGS

The invention is described herein with reference to the drawings in which.

DETAILED DESCRIPTION OF THE INVENTION

For purposes of illustration only, the invention will be described in the context of a vehicular traffic counting system. Those of ordinary skill will recognize that the invention is not limited to vehicular traffic counter applications and that the invention can be used in any context where it is desirable to transmit an acoustic pulse for any purpose.

Figure 1:
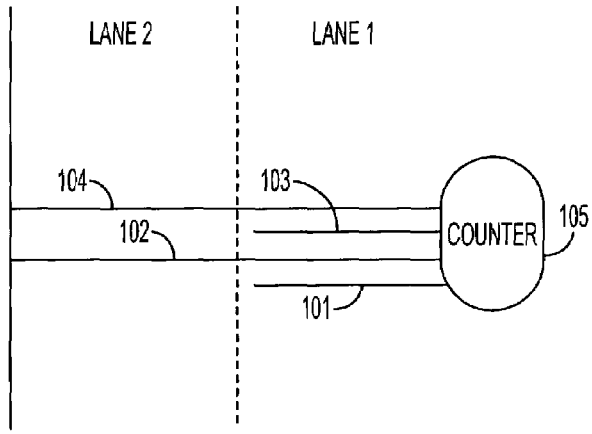
FIG. 1 illustrates a conventional traffic counting system configuration.
Figure 2:
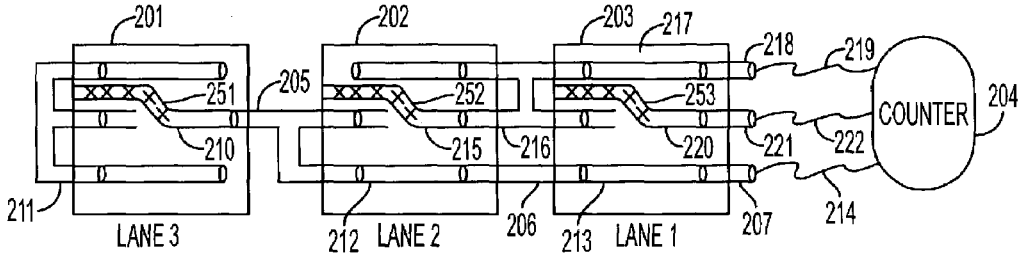
FIG. 2 illustrates an event counting system according to the invention

An exemplary event detector according to the invention is shown in FIG. 2. Those of ordinary skill will recognize that the detector shown in FIG. 2 is by way of example and not limitation, as traffic detectors can take numerous physical shapes and be configured to accommodate any number of traffic lanes. FIG. 2 illustrates a traffic detector system in a three lane counter configuration. In this configuration carrier segments 201, 202 and 203 are appropriately connected together for connection to a conventional multi-channel traffic counter 204 activated by acoustic pulses. Such pulses are created when traffic passes over a carrier segment. The carrier segments are connected together using connector elements 205, 206 and 207 discussed further herein. As previously noted, conventional systems employ a plurality of pneumatic tubes of different lengths individually connected to one or more counters in order to count multiple lanes of traffic. The present invention provides the advantage of allowing a user to configure a system to count any number of traffic lanes quickly and easily simply by connecting together several carrier segments prepared in advance to count individual lanes as desired. Moreover, the segments can be prepared on site and modified to accommodate changing needs and circumstances as discussed further herein. Indeed, a product according to the invention can also be provided in kit form, as discussed further herein. Those of ordinary skill will recognize that a carrier can be formed by one or more carrier segments.

Figure 3:
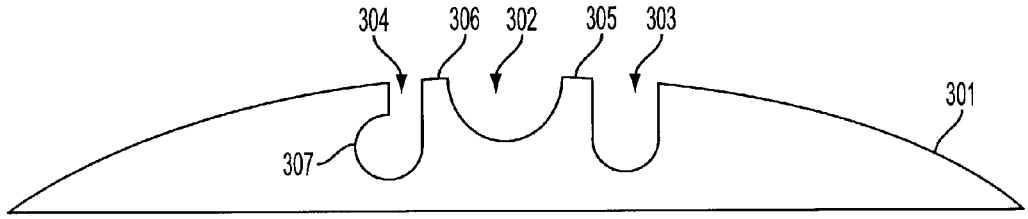
FIG. 3 illustrates a carrier segment according to the invention having space for at least two acoustic pulse carrier tubes.
Figure 4:
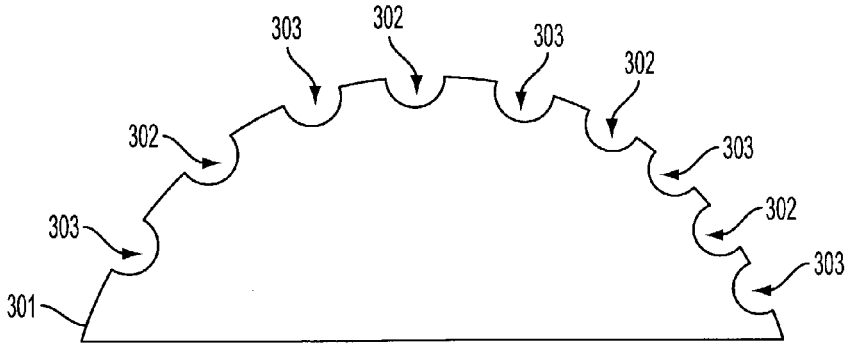
FIG. 4 illustrates a carrier segment according to the invention having slots for additional acoustic pulse carrier tubes.

FIG. 3 is a side view of a carrier segment according to the invention. For purposes of illustration only, the carrier segment shown in FIG. 3 is configured to accommodate two acoustic tubes and one pneumatic tube. The carrier can be made to accommodate any desired number of acoustic and pneumatic tubes. The only limits on the number of acoustic and pneumatic tubes that can be accommodated in a carrier are those size and flexibility constraints imposed by the user and designer. FIG. 4, for example illustrates a carrier that can accommodate a larger number of acoustic tubes.

Returning to FIG. 3, carrier segment 301 has a base portion 300. Within base 300 is a pneumatic tube slot 302 and acoustic tube slots 303 and 304. The pneumatic tube slot 302 is separated from acoustic tube slots 303 and 304 by walls formed of carrier material portions 305 and 306. FIG. 3 illustrates alternative acoustic tube slot shapes. Slot 303 is shown having a U-shape configuration with a substantially uniform width and straight interior edge for most of its depth, for ease of placing the acoustic tube in the slot. Slot 304 is shown having a narrow opening at the insertion end with a wider radius where the acoustic tube remains after being placed in the slot. A portion 307 of carrier material resiliently springs over a portion of the acoustic tube thereby providing it additional protection from wear and tear. Either configuration of tube slot may be used. In addition, other tube slots configurations are also possible within the scope of the invention. FIG. 4 illustrates by way of example and not limitation one embodiment with multiple slots for pneumatic and acoustic pulse carrier tubes. Other configurations within the scope of the invention may also be formed using different numbers and arrangements of slots for acoustic pulse carrier tubes and pneumatic tubes.

Figure 5:
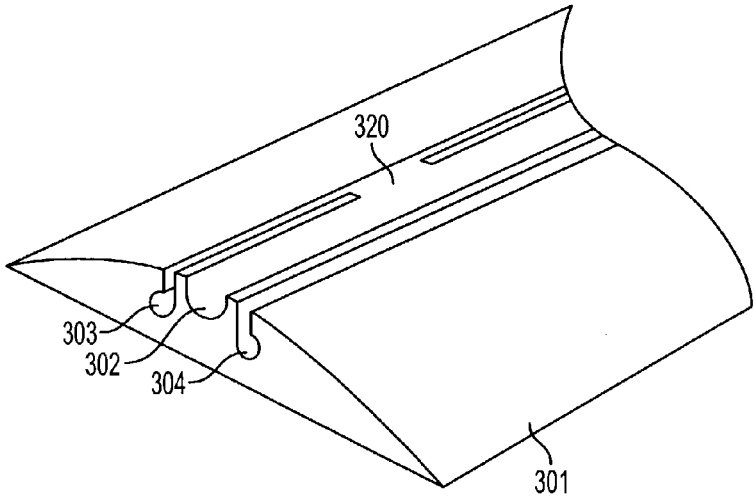
FIG. 5 is a perspective view illustrating an empty carrier according to the invention
Figure 6:
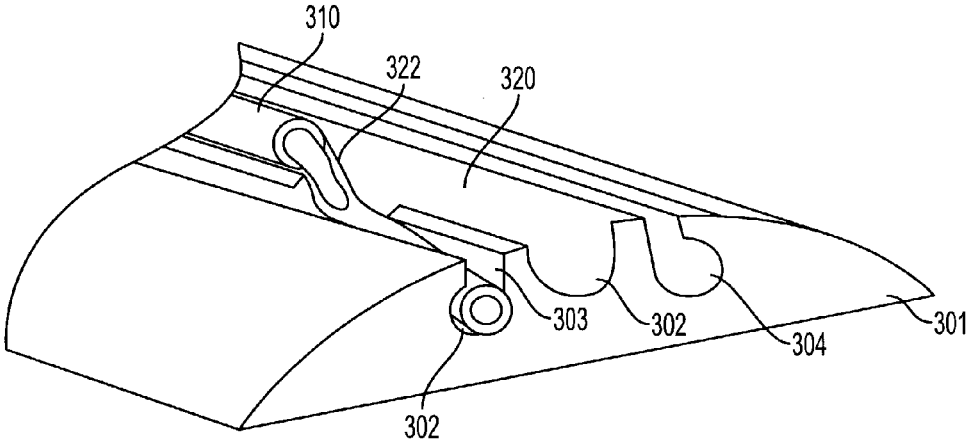
FIG. 6 is a perspective view illustrating a carrier according to the invention having an acoustic pulse carrier tube in one of its slots connected to an acoustic pulse generating tube therein.
Figure 7:
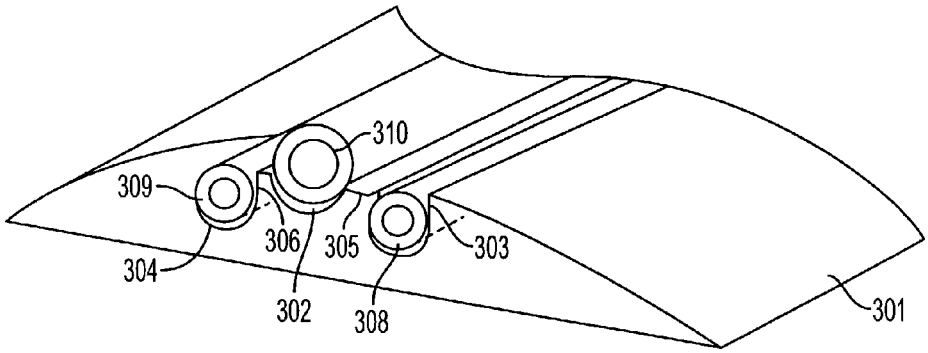
FIG. 7 is a perspective view of a carrier according to the invention having an acoustic pulse carrier tube in each of its slots and an acoustic pulse generating pneumatic tube therein.

FIGS. 5, 6 and 7 illustrate perspective views of carrier segment 301 at various stages of assembly. FIG. 5 illustrates an empty carrier segment 301 in perspective having tube slots 303 and 304, both with the tube slot configuration described above with respect to slot 304. FIG. 6 shows carrier 301 with an acoustic pulse carrier tube 308 inserted into acoustic tube slot 304. FIG. 7 illustrates carrier 301 with acoustic pulse carrier tube 309 inserted into acoustic tube slot 303 and pneumatic tube 310 inserted into pneumatic tube slot 302. Pneumatic tube 310 can be any type of pneumatic tube known to those of ordinary skill. Low Profile Hose (LPH) is one form of pneumatic tube that would be acceptable in this application. The acoustic pulse carrier tubes 308, 309 can be any tubes of sufficient durability that will not crush and will allow an acoustic pulse to move through them. For example the tubes can be made of metal or plastic.

As shown in FIGS. 2–9, carrier 301 is generally shaped like a ramp. While this may be an appropriate shape for vehicular traffic counting applications, other shapes can be used in other applications without departing from the scope of the invention.

Figure 8:
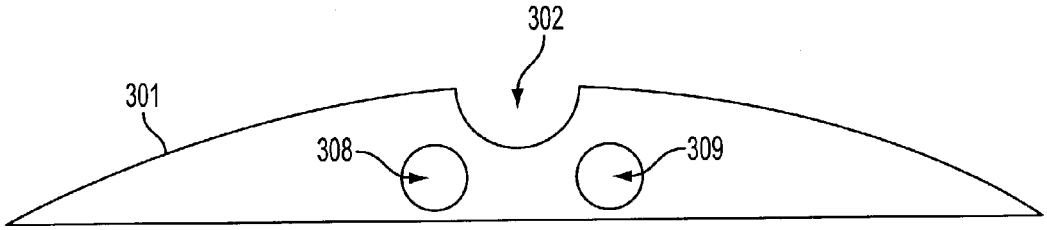
FIG. 8 illustrates another configuration of a carrier segment according to the invention with acoustic pulse carrier tubes embedded therein.
Figure 9:
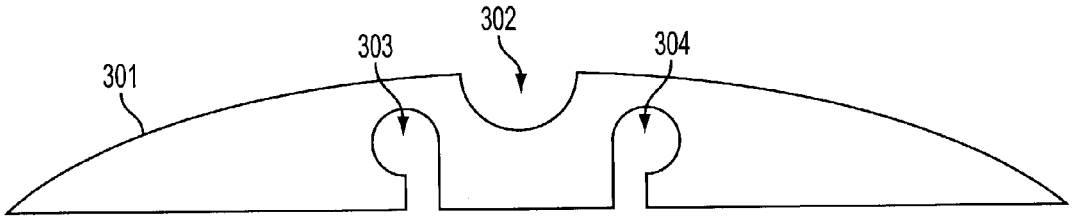
FIG. 9 illustrates another configuration of a carrier segment according to the invention in which acoustic pulse carrier tubes can be inserted from a bottom portion of the carrier segment.

FIGS. 8 and 9 illustrate other forms of a carrier according to the invention. FIG. 8 illustrates a form where the acoustic pulse carrier tubes 308 and 309 are built into the carrier rather than being inserted. FIG. 9 illustrates a form where the acoustic pulse carrier tubes 308 and 309 are inserted into acoustic tube slots from a bottom portion of carrier 301. Of course, in any configuration, pneumatic tube 310 can also be built into the carrier 301 rather than being inserted.

In any configuration, it is necessary to form an acoustic pulse generator to generate an acoustic pulse and transmit the desired acoustic pulse from a pneumatic tube to an acoustic pulse carrier tube. This is accomplished by connecting selected acoustic pulse carrier tubes to the pneumatic tubes as desired to transmit an acoustic pulse corresponding to a particular event. Connection of the acoustic pulse carrier tubes to the pneumatic tubes is accomplished by forming a passage, such as trough 320 in FIGS. 5 and 6, in the material between the pneumatic tube and the acoustic tube slots. The trough is used as passage to connect the pneumatic tube to the corresponding acoustic pulse carrier tube in the trough. An example is shown at connection 322 in FIG. 6. Here pneumatic tube 310 connects to acoustic pulse carrier tube 308 through a trough between pneumatic tube carrier slot 302 and acoustic pulse tube carrier slot 303. Such troughs can be formed at the time of manufacture, or can be formed, for example, by cutting away a portion of the material 305 or 306. Such cutting can be done on site and those of ordinary skill will recognize that a carrier segment can be reconfigured simply by cutting new troughs and making new connections between the pneumatic tube and the acoustic pulse carrier tube. One makes the connection simply by routing the pneumatic tube through the passage or trough and connecting the pneumatic tube to the free end of the acoustic pulse carrier tube within the trough. Depending on the configuration change required, it may be possible to use the same pneumatic and/or acoustic pulse carrier tube. In any case, replacing either the pneumatic tube or the acoustic pulse carrier tube or both allows indefinite reuse of the carrier segment.

Depressing the pneumatic tube, for example by passing an item to be counted over it, generates an acoustic pulse. Since the pneumatic tube is connected to one of the acoustic pulse carrier tubes in a trough as discussed above, the acoustic pulse is transmitted from the pneumatic tube to the acoustic pulse carrier tube connected to that pneumatic tube. Acoustic pulses are thus transmitted from the pneumatic tube to one of the acoustic pulse carrier tubes, which carries the acoustic pulse through the carrier segment toward the counting device. Carrier segments can be connected together in order to carry an acoustic pulse from a distant segment through one or more carrier segments nearer the counting device. These carrier segments can also be responsive to separate stimuli by connecting a pneumatic tube in that segment to a different acoustic carrier tube.

It will be recognized that for events occurring in separate lanes, multi-channel counts can be recorded depending on the routing of connections between the pneumatic and acoustic tubes. For example, by using one acoustic tube for each of several vehicular traffic lanes or processing lines in a manufacturing plant, and connecting the pneumatic tube to an acoustic tube, the acoustic tube can route the pulse to a counter that counts the number of events in that lane Returning to FIG. 2, this Figure schematically illustrates a traffic counter system configured according to the invention. For ease of illustration, FIG. 2 does not detail the pneumatic tubes connected to the acoustic pulse carrier tubes. In FIG. 2, lane 3 is configured such that a pneumatic tube 251 in the portion 201 is connected to an acoustic pulse carrier tube 210 using the connection methods discussed previously herein. Thus, a vehicle passing over the pneumatic tube 251 in carrier segment 201 generates an acoustic pulse that is transmitted to acoustic pulse carrier tube 210. As the last carrier segment, segment 201 has an end molding 211 built in or inserted into the acoustic pulse carrier tube in order to seal the acoustic pulse carrier tube that carries the pulse and prevent the acoustic pulse from escaping from that acoustic pulse carrier tube. While FIG. 2 shows the end molding 211 inserted into all the acoustic pulse carrier tubes, those of ordinary skill will recognize that the end molding need only be inserted to seal the acoustic pulse carrier tube that is connected to the pneumatic tube to carry an acoustic pulse. Remaining acoustic tubes in the carrier segment that are not used need not be sealed with an end molding.

The acoustic pulse that was transferred to acoustic pulse tube 210 in carrier segment 201 proceeds through connector 205 to acoustic tube 212 in carrier segment 202. The acoustic pulse next proceeds through connector 206 to acoustic pulse carrier tube 213 in carrier segment 203. Finally, the acoustic pulse proceeds through connector 207 to counter tube 214 which routes the acoustic pulse to the counting device 204.

FIG. 2 further illustrates that segment 202 has acoustic tube 215 which receives pulses from a pneumatic tube 252 compressed by vehicles travelling in a second traffic lane. Acoustic pulses travel through acoustic pulse carrier tube 215 and connector 216 through acoustic pulse tube 217 in carrier segment 203. The pulses are then routed through connector 218 to counter tube 219 which routes the acoustic pulse to counter 204. In this configuration carrier segment 202 serves two purposes. First, carrier segment 202 serves to carry acoustic pulses generated in lane 3 toward the counter. Independently, carrier segment 202 generates acoustic pulses for traffic in lane 2 and routes those pulses toward the counter.

Carrier segment 203 operates in a similar fashion to count traffic travelling in lane 1 and to facilitate passage of acoustic pulses generated by traffic in lanes 2 and 3. In the case of lane 1 the user connects a pneumatic tube 253 to acoustic pulse carrier tube 220 for connection to the counter through connector 221 and counter tube 222. Alternatively, since it is not necessary to transmit the acoustic pulse through any additional carrier segments, the user could simply connect the pneumatic tube 253 directly to counter tube 222 or directly to the counter 204.

Those of ordinary skill will recognize that any custom configuration is possible. For example, if a user wished to count events in lanes 2 and 3, but ignore events in lane 1, the user could configure carrier segment 203 without an acoustic pulse generator, for example by omitting the pneumatic tube. In this case carrier segment 203 serves merely as a conduit to carry acoustic pulses from lanes 2 and 3 in acoustic pulse tubes 213 and 215.

As illustrated in FIG. 2, the acoustic pulse carrier tubes in segments 201, 202 and 203 are slightly shorter than the length of the segments themselves. As previously noted, the acoustic pulse carrier tubes should be substantially non-compressible in order to provide a clear transmission path for the acoustic pulse and to prevent the introduction of unwanted noise pulses. Making the acoustic pulse carrier tubes of a length such that they do not extend all the way to the edge of the carrier segment is preferred in order to minimize such effects. This approach allows the acoustic pulse carrier tubes to remain totally within the carrier material, providing additional cushioning and isolation from such undesired effects. As shown in FIG. 2, connectors 205, 206 and 207 extend into the carrier segments to connect to the acoustic pulse carrier tubes 210, 212 and 213 within the carrier segment in order to facilitate this protection of the acoustic pulse carrier tubes. A similar approach is applied to the remaining connectors and acoustic pulse carrier tubes.

Figure 10:
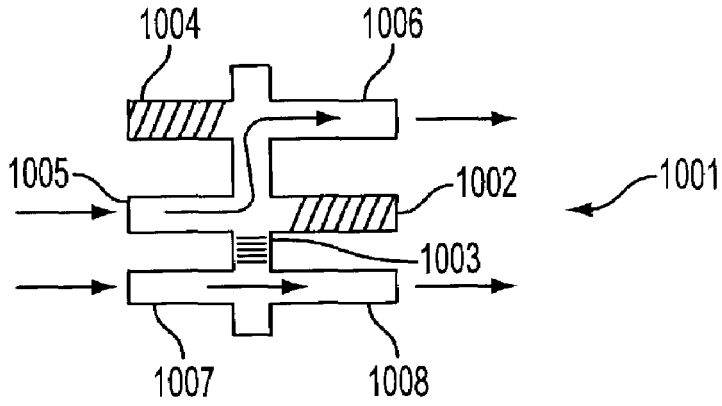
FIG. 10 illustrates one configuration of a carrier segment connector.

Connectors joining the carrier segments can have any suitable shape and configuration to accommodate the transmission of the acoustic pulses. For example, FIG. 10 illustrates one form of segment connector 1001 to join and cross over between the pneumatic tube and the acoustic pulse carrier tubes in connecting segments. The segment connector in FIG. 10 would find use in connecting segments having multiple acoustic pulse carrier tube slots. The cross hatched areas 1002, 1003 and 1004 represent arms of the segment connector that are plugged either when manufactured or by inserting plugs on site. The plugs in these segments prevent a pneumatic or acoustic pulse from travelling down that arm. As a result, an acoustic pulse is routed through the clear paths from one acoustic pulse carrier tube in a first carrier segment connected to arm 1005 and through arm 1006 to a first acoustic pulse carrier tube in a second carrier segment connected to arm 1006. Similarly, an acoustic pulse in a second acoustic pulse carrier tube in the first carrier segment is connected to arm 1007 and routed through arm 1008 to a second acoustic pulse carrier tube in the second carrier segment. Any number of such clear paths can be incorporated into the segment connectors, for use depending on the application. Those of ordinary skill will recognize that such segment connectors can be made in any desired configuration or shape and can be manufactured in such shapes and configurations or assembled on site with interlocking parts into desired shapes and configurations. Similarly, the sealed arms of such connectors can be formed by manufacturing the arms with permanently closed passages or by inserting individual plugs into the arms being sealed.

Figure 11:
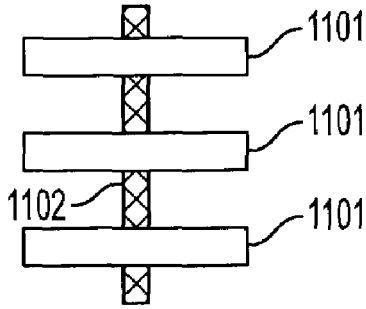
FIG. 11 illustrates another configuration of a carrier segment connector.

FIG. 11 illustrates a plurality of straight-through connectors 1101 that can be used to allow acoustic pulses to travel from one carrier segment to another. Such straight-through connectors are shown in FIG. 11 connected together on web 1102 to form a single unit. However, individual straight-thorough connectors can also be used.

Figure 12:
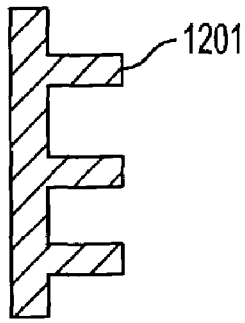
FIG. 12 illustrates an end molding for sealing a carrier segment according to the invention.

FIG. 12 illustrates an end block 1201 for use to seal acoustic tubes in carriers according to the invention. Those of ordinary skill will recognize that such end blocks can be solid or can be formed with plugs. In addition, individual plus can be used in place of an end block.

Those of ordinary skill will recognize that the invention can take numerous forms and can be applied to any system which requires transporting acoustic pulses. Such systems include, but are not limited to, event counters, such as traffic counters. In such systems it may be desirable to form the carrier segment in the shape of a ramp to facilitate vehicle travel onto and off of the carrier segment. Other forms of carrier segment are also possible. The invention can be supplied as a finished manufactured unit or can be supplied as parts that can be assembled on site for a custom application. A system according to the invention can be supplied in kit form, for example, with parts such as a carrier, pneumatic tubes and acoustic pulse carrier tubes. For example, desired lengths of carrier, pneumatic tube and acoustic pulse carrier tubes can be cut from spools of such material. An optional cutting tool to form the required troughs can also be supplied with such a kit.

Figure 13:
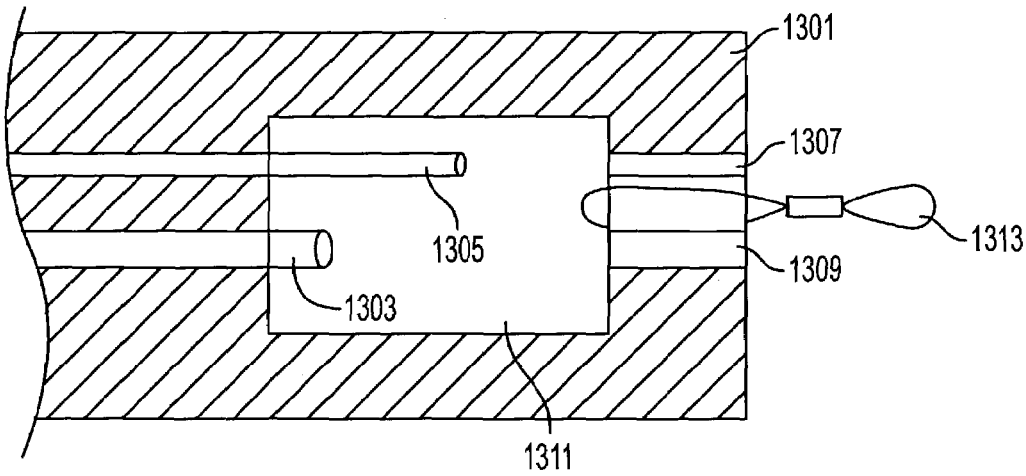
FIG. 13 illustrates another optional embodiment with a window to provide hand access and strain relief.

FIG. 13 illustrates still another optional feature according to the invention. FIG. 13 shows a top view of carrier segment 1301 having a pneumatic pulse generator tube 1303 and an acoustic pulse tube 1305, as well as acoustic tube slot 1307 and pneumatic tube slot 1309. In order to facilitate connection to another carrier segment or other device, carrier segment 1301 can be formed with window or hole 1311 therein. Window 1311 provides an accessible area for a user's hands to make connections to the acoustic pulse tube 1305 and pneumatic pulse generator tube 1303. In addition, because the window is open at the bottom, acoustic pulse tube 1305 and pneumatic tube 1303 are elevated off the surface, e.g. a road, on which the carrier segment 1301 rests. When an object strikes the carrier segment compressing the pneumatic and acoustic tubes, the open area at the bottom provides strain relief. In a traffic counting application, window 1311 would typically be placed at the traffic lane division. FIG. 13 also shows a lifting member 1313 attached to said carrier segment to lift an end portion of said carrier segment. The lifting member shown is, for example, a wire extending through the window 1311 and forming a loop outside the carrier segment, so that the loop outside the carrier segment provides ease of lifting the carrier segment. Other suitable lifting members may also be used within the scope of the invention.

Those of ordinary skill will recognize that the invention can take other forms and is not limited to the specific embodiments herein and that various modifications and changes could be made to the invention without departing from the spirit and scope thereof as recited in the claims.

What is claimed is:

1. A traffic data collection apparatus comprising a plurality of carrier segments, each of said carrier segments having at least one acoustic tube slot, a first of said carrier segments having a first acoustic pulse generator, said first acoustic pulse generator being connected to a first acoustic pulse carrier tube in a first acoustic tube slot in said first of said carrier segments, said first acoustic pulse carrier tube in said first of said carrier segments being connected to a first acoustic pulse carrier tube in a second of said carrier segments, said first acoustic pulse carrier tube in said second of said carrier segments being in a first acoustic tube slot in said second of said carrier segments.

2. A traffic data collection apparatus as recited in claim 1, said second of said carrier segments comprising a second acoustic pulse generator, said second acoustic pulse generator being connected to a second acoustic pulse carrier tube.

3. A traffic data collection apparatus as recited in claim 2, said second acoustic pulse carrier tube being in a second acoustic tube slot in said second of said carrier segments.

4. A traffic data collection apparatus as recited in claim 1 each of said segments being configured to collect data in a different lane of traffic.

5. A multi-lane traffic data collection apparatus comprising:

at least one carrier segment having at least one acoustic slot, said one carrier segment comprising an acoustic pulse generator, said acoustic pulse generator being connected to a pulse carrier tube in at least one acoustic slot in said carrier segment, said at least one carrier segment being configured to detect traffic crossing over one lane of traffic; and a traffic detector for detecting traffic in a traffic lane different from said one lane, said traffic detector comprising a second carrier segment having a first acoustic pulse carrier tube for connection to said acoustic pulse carrier tube in said one carrier segment and a separate acoustic pulse generator connected to a second acoustic pulse carrier tube therein.

6. A multi-lane traffic data collection apparatus as recited in claim 5, said one carrier segment being for detecting traffic in a first traffic lane and said second carrier segment being for detecting traffic in a second traffic lane.

7. A multi-lane traffic data collection apparatus as recited in claim 5, said traffic detector comprising a pneumatic pulse generating tube.

* * * * *